US007064724B2

(12) United States Patent
Louzir et al.

(10) Patent No.: US 7,064,724 B2
(45) Date of Patent: Jun. 20, 2006

(54) MULTIBAND PLANAR ANTENNA

(75) Inventors: Ali Louzir, Rennes (FR); Philippe Minard, Saint Medard sur Ille (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/928,991

(22) Filed: Aug. 27, 2004

(65) Prior Publication Data

US 2005/0057413 A1 Mar. 17, 2005

(30) Foreign Application Priority Data

Aug. 29, 2003 (FR) ..... 03 50472

(51) Int. Cl.
*H01Q 13/10* (2006.01)

(52) U.S. Cl. ..... 343/770; 343/769

(58) Field of Classification Search ..... 343/767, 343/770, 700 MS, 768, 769, 725, 728, 729; H01Q 13/10
See application file for complete search history.

(56) References Cited

U.S. PATENT DOCUMENTS 6,891,510 B1 * 5/2005 Le Bolzer et al. ..... 343/767
6,917,342 B1 * 7/2005 Thudor et al. ..... 343/770

FOREIGN PATENT DOCUMENTS

FR 2 821 503 8/2002
WO WO 03/058758 A1 7/2003

OTHER PUBLICATIONS

Search Report.
Kolsrud A T et al., "Electronically Switchable Slot Antenna Fed By Microstrip Line.", Antennas and Propagation Society International Symposium, 1998, New York, NY USA IEEE, US, p. (S) 1180-1183 XP010292351 Isbn: 0-7803-4478-2.
Hirsoe K et al., Dual-Loop Slot Antenna With Simple Feed), Electronics Letters, IEE Stevenage, GB, vol. 25 No. 18, 1989 pp. 1218-1219 XP000081699 ISSN: 0013-5194.

* cited by examiner

*Primary Examiner*—Hoanganh Le
(74) *Attorney, Agent, or Firm*—Joseph J. Laks; Robert D. Shedd; Brian J. Cromarty

(57) ABSTRACT

The present invention relates to a multiband planar antenna comprising, on a substrate having a ground plane, at least a first slot dimensioned for operation at a first frequency and a second slot dimensioned for operation at a second frequency, the two slots having a closed shape and being excited by a common supply line. Furthermore, the slots are coupled to the supply line such that the coupling with the first slot is implemented in an electrical plane of the supply line of a first type and the coupling with the second slot is implemented in an electrical plane of the supply line of a second type, the supply line having, at its free end, a control element comprising two states allowing the type of electrical plane at the coupling points of the line with the first and second slots to be modified, the slots being positioned with respect to the supply line such that only one of them radiates for a given state of the control element.

This antenna can operate in at least two frequency bands such as that around 2.4 GHz and that around 5 GHz.

8 Claims, 3 Drawing Sheets

MULTIBAND PLANAR ANTENNA

This application claims the benefit, under 35 U.S.C. 119, of France patent application No. 0350472 filed Aug. 29, 2003.

FIELD OF THE INVENTION

The present invention relates to an antenna operating in several frequency bands, more especially in two frequency bands, but comprising a single access. It relates, in particular, to antennas for known local wireless networks such as WLAN (Wireless Local Area Networks) which can function in two modes corresponding to two standards operating at two different frequencies.

BACKGROUND OF THE INVENTION

In fact, the development of wideband wireless networks has been so successful that several standards coexist. Amongst the various standards may be mentioned HYPERLAN or IEEE802.11A, which operate in frequency bands situated around 5 GHz, but also IEEE802.11B and IEEE802.11G which operate in frequency bands situated around 2.4 GHz.

In the field of mobile devices, it is desirable to be able to offer low-cost, compact products that can operate at one or the other of the frequencies with interfaces and signal processing circuits having the maximum functionalities common to the two frequencies. These products must offer a common antenna access for the two frequencies. Accordingly, the antenna used can be an antenna having a very wide frequency band, including the frequencies 2.4 GHz and 5 GHz, or an antenna having a double frequency band, namely separately covering two separate bands at 2.4 GHz and 5 GHz. However, such a system that allows the size and especially the equipment production cost to be minimized may suffer from noise and interference coming from the unused band.

Consequently, the present invention proposes an antenna that allows switching from one band of operation to the other according to the operating mode being used by the equipment and the effects of noise and interference coming from the other band to be minimized.

BRIEF DESCRIPTION OF THE INVENTION

Thus, the subject of the invention is a multiband planar antenna comprising, on a substrate having a ground plane, at least a first slot dimensioned for operation at a first frequency and a second slot dimensioned for operation at a second frequency, the two slots having a closed shape and being excited by a common supply line.

According to the invention, the slots are coupled to the supply line such that the coupling with the first slot is implemented in an electrical plane of the supply line of a first type and the coupling with the second slot is implemented in an electrical plane of the supply line of a second type, the supply line having, at its free end, a control element comprising two states allowing the type of electrical plane at the coupling point of the line with the first and second slots to be modified, the slots being positioned with respect to the supply line such that only one of them radiates for a given state of the control element.

Preferably, the first and second types of electrical plane are formed by a short-circuit plane or an open circuit plane at the operating frequency of the slot. The control element is formed by a diode, a transistor, a switching circuit or MEMS (MicroElectroMechanical System) and the closed shape is a circle, a polygon or another closed shape whose diameter is such that $P_i=k'\lambda s_i$, where k' is a positive integer and $\lambda s_i$ the wavelength in the slot i, with i representing the number of the slot.

Thus, the present invention relates to an antenna preferably comprising annular slots that operate in their fundamental mode around an exciting supply line and which are capable of being coupled or not to this line.

BRIEF DESCRIPTION OF THE DRAWINGS

Other features and advantages of the present invention will become apparent upon reading the description of the various embodiments, this description being presented with reference to the appended drawings in which.

In the figures, the same elements are designated using the same references.

DESCRIPTION OF PREFERRED EMBODIMENTS

Figure 1:
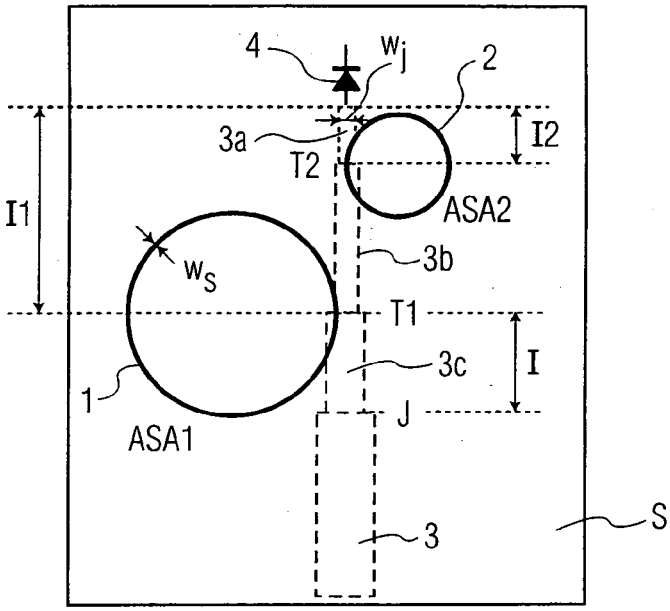
FIG. 1 is a schematic top view of a first embodiment of an antenna according to the present invention.

With reference to FIGS. 1 and 2, a first embodiment of an antenna according to the present invention will now be described.

As shown in FIG. 1, on a substrate S having a ground plane, the antenna according to the present invention comprises a first slot 1 formed by an annular slot obtained by etching the ground plane and a second annular shot 2 obtained in an identical manner to the first slot 1.

According to the present invention, the two annular slots 1 and 2 have perimeters $P_1$ and $P_2$ such that they each operate in their fundamental mode. More particularly, the annular slot 1 has a perimeter $P_1=\lambda s_1$, where $\lambda s_1$ is the wavelength in the slot 1 and the annular slot 2 has a perimeter $P_2=\lambda s_2$, where $\lambda s_2$ is the wavelength in the slot 2. In fact, the two slots are dimensioned for one to operate at 2.4 GHz and the other at 5 GHz.

According to the present invention and as shown in FIG. 1, the two annular slots 1 and 2 are excited by means of a single supply line 3 which, in the embodiment shown, is tangential to each of the annular slots 1 and 2 and causes the excitation of one or the other of the slots by electromagnetic coupling. In addition, as shown in FIG. 1, a control element is provided at the free end of the supply line 3 allowing either an open circuit or a short-circuit to be obtained at the end of the supply line 3. In the embodiment of FIG. 1, this control element is formed by a diode PIN4 of which one end is connected to the supply line and the other end to the ground plane by means of, for example, a plated-through hole, via or other means allowing ground to be brought to this end. This diode is controlled to be either in an on or off state, as will be explained in more detail below.

In order to achieve operation in a switched mode of one or the other of the two annular slots 1 or 2, the annular slots 1 or 2 are positioned along the single supply line 3 such that the coupling of the line 3 with the first slot 1 is implemented in an electrical plane of the supply line 3 of a first type, namely a short-circuit plane or an open circuit plane, and the coupling with the second slot 2 is implemented in an electrical plane of the supply line 3 of a second type, namely an open circuit plane or a short-circuit plane. The coupling planes are designated by T1 and T2 in FIG. 1.

Thus, for a given state of the diode, for example a diode in the off state, if an annular slot operating at the frequency f1 has the short-circuit condition at the coupling point, it must be ensured that the other annular slot operating at the frequency f2 has a non-short-circuit condition, more particularly an open circuit condition. In order to provide an alternate operation at one or the other of the frequencies for the antenna system, these conditions must be inverted at the coupling point T2, T1 when the diode changes state, namely switches to an open state. Assuming that the antenna operates at the frequency f2 when the diode is in the off state and that it operates at the frequency f1 when the diode is in the on state, in the embodiment of FIG. 1 where the smaller diameter slot 2 is closer to the diode PIN4 than the larger diameter slot 1, the following necessary conditions for the dimensions 12 and 11 relating to the length of line between the diode and the coupling point must be met:

$$l_2=\lambda_2/4+k_2\lambda_2/2$$

$$l_1=\lambda_1/2+k_1\lambda_1/2$$

with the index 1 relating to the frequency f1 and the index 2 relating to the frequency f2 and the frequency f1 being lower than the frequency f2, $\lambda_i$ being the guided wavelength at the frequency fi in the supply line 3 and $k_i$ being a positive integer or zero.

According to another feature of the present invention, in order to avoid interference, when the diode 4 is in the off state, the distance 11 is such that the electrical plane passing through the coupling point T2 with the slot 2 at the frequency f2 is not a short-circuit plane. Various solutions may be adopted in order to avoid interference if the electrical plane passing through the coupling point T1 is a short-circuit plane at the frequency f2. Thus, it is arranged that the annular slot 1 does not possess a higher mode that coincides with the frequency f2. In order to achieve this, the section of line between the diode 4 and the coupling point T2, together with the section of line between the coupling points T2 and T1 or the section of line between the coupling point and j have widths Wj which are matched, as shown by 3*a*, 3*b* and 3*c* in FIG. 1.

Similarly, the same result can be obtained by modifying the width Ws of the slot forming the annular slot 1. Thus, by adjusting the widths of the supply line and of the annular slots at the frequency i, it can be guaranteed that the slot i operates solely at the frequency i and not at the frequency j. For correct coupling, not only the short-circuit conditions on the line need to be present, but also the impedance ratios between the line and the slot need to be adjusted for correct operation at the working frequency, which effectively entails adjusting the widths of the line and of the annular slot.

According to another feature of the present invention, the length and characteristic impedance of the section of line 3*c*, between the coupling point T1 and the matching line j, are adjusted so that a good matching of the antenna is obtained for both states of operation, off or on, of the diode and for both operating frequencies of the antenna. Several sections of line or any other matching technique may be used in order to achieve the desired impedance matching conditions.

Figure 2A:
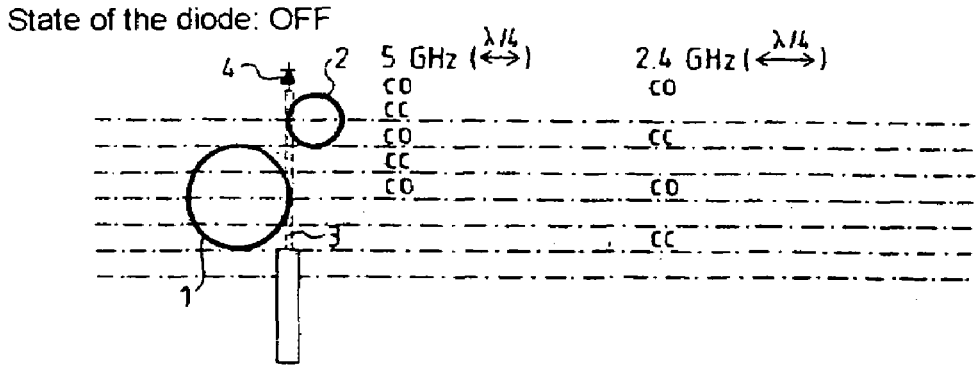
FIG. 2*a* and FIG. 2*b* are diagrams explaining the operation of the antenna in FIG. 1.
Figure 2B:
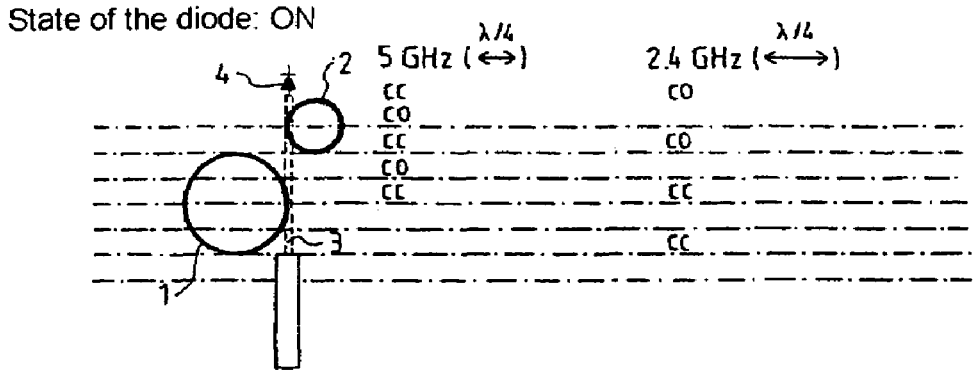

The operation of the antenna shown in FIG. 1 is represented symbolically in FIGS. 2*a* and 2*b*.

As is shown in FIG. 2*a*, when the diode 4 is in its off state, an open circuit plane is obtained at the end of the supply line 3. In this case, the coupling point of the antenna 2 operating at the frequency f2 is situated in a short-circuit plane when the dimensions have been chosen as mentioned above, whereas the coupling point of the circular slot 1 with the supply line 3 is situated in an open circuit plane, this configuration giving an operation at 5 GHz. For operation at 2.4 GHz, the coupling point of the annular slot 2 is not situated in any particular plane whereas the coupling point of the annular slot 1 is situated in an open circuit plane. Thus, with the diode 4 in an off state, the structure radiates at 5 GHz.

As shown in FIG. 2*b*, in the case where the diode 4 is in the on state, the end of the line 3 is situated in a short-circuit plane. Accordingly, for 5 GHz, the coupling point of the slot 2 is situated in an open circuit plane whereas the coupling point of the slot 1 is situated in a short-circuit plane for 5 GHz. Similarly, for 2.4 GHz, the coupling plane of the slot 2 is unimportant whereas the coupling point of the slot 1 is situated in a short-circuit plane. Thus, when the diode 4 is in an on state, the system operates at 2.4 GHz.

As shown in the FIGS. 3*a* and 3*b*, a similar, but inverted, operation is observed when the larger diameter annular slot 1' is positioned tangentially to the supply line 3 close to the diode 4, while the smaller diameter annular slot 2' is positioned further away, the distances between the diode 4 and the coupling point of the two annular slots being calculated in the manner indicated below. In this case, $$l_{2'}=\lambda_{2'}/2+k_2\lambda_{2'}/2$$

$$l_{1'}=\lambda_{1'}/4+k_1\lambda_{1'}/2$$

with the index 1 relating to the frequency f1' of the slot 1' and the index 2 relating to the frequency f2' of the slot 2', $\lambda_{i'}$ being the guided wavelength at the frequency fi' in the supply line 3 and $k_i$ being a positive integer or zero.

In this case, when the diode 4 is in the off state, the end of the supply line 3 is situated in an open circuit plane and the coupling point of the larger diameter slot 1' is situated in an open circuit plane for 5 GHz and in a short-circuit plane for 2.4 GHz, respectively, whereas the coupling point of the smaller diameter slot 2' is situated in an open circuit plane for both frequencies 5 GHz and 2.4 GHz. Accordingly, the antenna guarantees an operation at 2.4 GHz. Similarly, when the diode 4 is in the on state, the end of the supply line 3 is in a short-circuit plane and the coupling point of the larger diameter annular slot 2' is situated in a short-circuit plane for 5 GHz and in an open circuit plane for 2.4 GHz, respectively, whereas the coupling point of the smaller diameter slot 1' is situated in a short-circuit plane for both 5 GHz and 2.4 GHz, respectively. In this case, operation of the antenna at 5 GHz is therefore guaranteed.

Figure 3A:
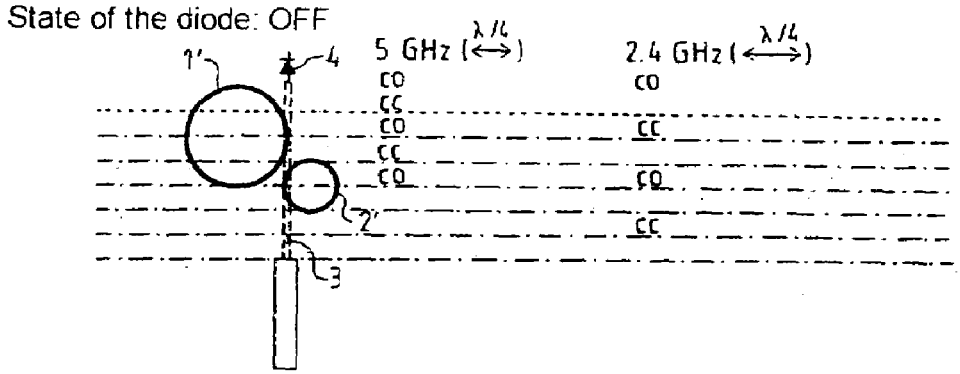
FIG. 3*a* and FIG. 3*b* are diagrams explaining the operation of an antenna according to another embodiment of the present invention.
Figure 3B:
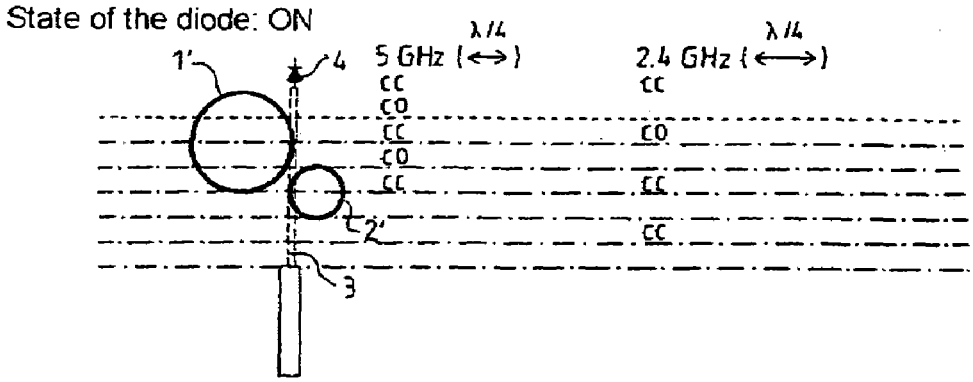

In summary, for the structure described in FIGS. 3*a* and 3*b*, the antenna guarantees an operation at 2.4 GHz when the diode is in the off state, and an operation at 5 GHz when the diode is in the on state.

Figure 4:
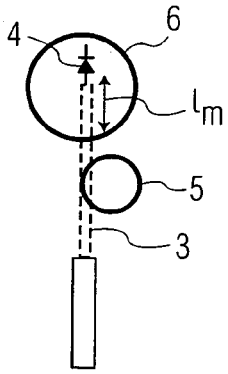
FIGS. 4 to 7 are schematic views of other embodiments.

The present invention has been described with reference to annular slots positioned tangentially to the supply line 3 on either side of this supply line, so as to obtain electromagnetic coupling. However, other coupling modes may be employed, in particular as shown in FIG. 4. In this case, one of the annular slots can be coupled tangentially to the supply line 3, namely the smaller diameter slot 5, whereas the slot 6 is supplied by electromagnetic coupling according to the Knorr method, where the supply line 3 extends past the point of intersection and coupling with the slot 6 by a distance $l_m=\alpha\lambda_m/4$ where $\lambda_m$ is the guided wavelength under the slot and $\alpha$ a positive integer or zero, the supply line 3 being terminated by a diode 4, as in the previous embodiments.

Figure 5:
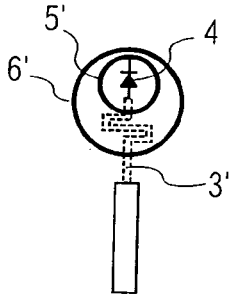

According to another variant shown in FIG. 5, the smaller diameter slot 5' can be positioned inside the slot 6' taking the ratio of the diameters of the two annular slots into account. In this embodiment, the supply via line 3' is a supply of the Knorr type with, for example, $l_{6'}=\lambda_{6'}/2$ and $l_{5'}=\lambda_{5'}/4$.

Figure 6:
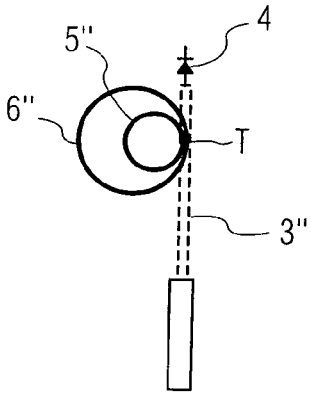

According to a variant of the embodiment in FIG. 5, shown in FIG. 6, the two slots 5" and 6" are placed one inside the other and are cotangent with each other. In this case, the two slots are supplied tangentially at the tangent point T with, for example, $$l_{5''}=\lambda_{5''}/2$$

$$l_{6''}=\lambda_{6''}/4$$

where $l_{5''}$ and $l_{6''}$ represent the length of line between the point of coupling of the slots 5" and 6" with the supply line and the diode 4.

The solutions in FIGS. 5 and 6 yield a more compact antenna.

Figure 7:
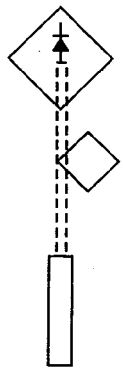

Other variants in terms of the coupling configuration may be used. Similarly, the present invention has been described with reference to annular slots. However, slots having other closed shapes maybe be used, such as square slots as show in FIG. 7, polygonal slots or any other symmetrical closed shape. The control means for the switching is represented in the figures by a diode. However, other switching means may also be employed such as MEMS (Micro Electro Mechanical Systems), transistors or similar devices. In the embodiment shown, the supply line 3 is formed by a microstrip line, but other types of supply line may be employed, in particular coaxial cables. It is also possible to use several concentric annular slots in order to widen the bandwidth around the two operating frequencies.

What is claimed is:

1. A multiband planar antenna comprising:

a substrate with a ground plane, a first slot in the ground plane consisting of a closed curve dimensioned for operation at a first frequency, a second slot in the ground plane consisting of a closed curve dimensioned for operation at a second frequency, a common supply line exciting the first and the second slots, a two-state control element being provided between a free end of the supply line and the ground plane, the first slot being positioned along the common supply line at a first point such that the coupling of the line with the first slot is implemented in an electrical plane of the supply line of a first type, the second slot being positioned along the common supply line at a second point, such that the coupling of the line with the second slot is implemented in an electrical plane of the supply line of a second type so that according to the state of the control element, the antenna operates either at the first frequency or at the second frequency.

2. The antenna according to claim 1, wherein the first and second types of electrical plane are formed by a short-circuit plane or an open circuit plane at the operating frequency of a slot.

3. The antenna according to claim 1, wherein the control element is formed by a diode, a transistor, a switching circuit or MEMS (Micro Electro Mechanical System).

4. The antenna according to claim 1, wherein the closed curve forming the first and the second slots is a circle, a polygon or another closed shape whose diameter is such that $P_i=k'\lambda s_i$, where k' is a positive integer and $\lambda s_i$ the wavelength in the slot.

5. The antenna according to claim 1, wherein, if, where the first frequency is lower than the second frequency, it operates at the second frequency when the control element is in the off state and at the first frequency when the control element is in the on state, the distances between the control element and the coupling points between the supply line and the first and the second slots are given by the following equations:

$$l_2=\lambda_2/4+k_2\lambda_2/2$$

$$l_1=\lambda_1/2+k_1\lambda_1/2$$

$\lambda_i$ (i=1 or 2) being the guided wavelength at the frequency fi in the supply line and $k_i$(i=1 or 2) being a positive integer or zero.

6. The antenna according to claim 1, wherein, if, where the first frequency is lower than the second frequency, it operates at the first frequency when the control element is in the off state and at the second frequency when the control element is in the on state, the distances between the control element and the coupling points between the supply line and the first and the second slots are given by the following equations:

$$l_1=\lambda_1/4+k_1\lambda_1/2$$

$$l_2=\lambda_2/2+k_2\lambda_2/2$$

$\lambda_i$ (i=1 or 2) being the guided wavelength at the frequency fi in the supply line and $k_i$(i=1 or 2) being a positive integer or zero.

7. The antenna according to claim 1, wherein the first and second slots have a width chosen such that the higher modes of the a slot operating at the lower frequency do not correspond to the highest frequency.

8. The antenna according to claim 1, wherein the supply line is divided between the control elements the first slot, the second slot and a supply point in sections having width chosen such that the higher modes of a slot operating at the lower frequency do not correspond to the highest frequency.

* * * * *